US007448614B2

(12) United States Patent
Koga

(10) Patent No.: US 7,448,614 B2
(45) Date of Patent: Nov. 11, 2008

(54) SHEET FEEDING DEVICE AND IMAGE FORMING APPARATUS

(75) Inventor: Hiroto Koga, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 186 days.

(21) Appl. No.: 11/530,580

(22) Filed: Sep. 11, 2006

(65) Prior Publication Data

US 2007/0228635 A1 Oct. 4, 2007

(30) Foreign Application Priority Data

Mar. 31, 2006 (JP) ..... 2006-099058

(51) Int. Cl.
*B65H 1/08* (2006.01)

(52) U.S. Cl. ..... 271/171; 271/147; 271/148

(58) Field of Classification Search ..... 271/171, 271/148, 145, 147, 9.09, 3.02, 3.03, 13, 17, 271/10.12, 105, 144, 241, 240, 248, 253, 271/254, 221, 223; 399/376, 389, 392; 270/58.27, 270/58.12, 58.16, 58.17
See application file for complete search history.

(56) References Cited

U.S. PATENT DOCUMENTS 4,005,794 A * 2/1977 Lundquist ..... 271/161
4,280,692 A * 7/1981 Hutchinson et al. ..... 271/160
5,269,507 A * 12/1993 Yoshida ..... 271/170
5,366,216 A * 11/1994 Ahlvin ..... 271/171
5,397,119 A * 3/1995 Brewster et al. ..... 271/171
5,429,348 A * 7/1995 Martin ..... 271/96
5,611,528 A * 3/1997 Nakamura et al. ..... 271/164
5,803,631 A * 9/1998 Bingham et al. ..... 400/624
5,810,349 A * 9/1998 Bloser et al. ..... 271/213
5,857,670 A * 1/1999 Jung ..... 270/58.12
5,890,711 A * 4/1999 Kim ..... 271/127
5,944,308 A * 8/1999 McLeod et al. ..... 271/171
5,970,866 A * 10/1999 Okawa ..... 101/118
6,053,491 A * 4/2000 Cheong ..... 271/9.09

(Continued)

FOREIGN PATENT DOCUMENTS

JP 55084731 A * 6/1980

(Continued)

*Primary Examiner*—Patrick H Mackey
*Assistant Examiner*—Jeremy Severson
(74) *Attorney, Agent, or Firm*—Fitzpatrick, Cella, Harper & Scinto

(57) ABSTRACT

In a sheet storing portion, a sheet tray which supports a sheet and a side regulating plate which moves depending on a sheet size to regulate a side end of the sheet are arranged. A notched portion to make it possible to move the side regulating plate is formed in the sheet tray, and a swingable auxiliary tray which constitutes the same plane as that of a sheet support surface of the sheet tray is arranged in the notched portion to prevent the sheet from being hanged down at the notched portion of the sheet tray. A hole into which the auxiliary tray can be inserted is formed in a side surface of the side regulating plate for the sheet. When the sheet tray moves upward to a predetermined position, the auxiliary tray is designed such that the auxiliary tray is brought into contact with a contact portion formed on an upper end of the hole and is swingably retreated downward, so that a sheet regulating surface of the side regulating plate can be assured.

5 Claims, 9 Drawing Sheets

U.S. PATENT DOCUMENTS

| | | | | |
|---|---|---|---|---|
| 6,056,286 | A * | 5/2000 | Koga | 271/145 |
| 6,361,042 | B1 * | 3/2002 | Shimura et al. | 271/250 |
| 6,409,165 | B1 * | 6/2002 | Yamaoka et al. | 271/145 |
| 6,435,499 | B1 * | 8/2002 | Tomatsu | 271/147 |
| 6,871,848 | B2 * | 3/2005 | Matsushima et al. | 271/171 |
| 6,926,267 | B2 * | 8/2005 | Kobayashi | 271/3.14 |
| 7,140,605 | B2 | 11/2006 | Suga et al. | 271/97 |
| 7,140,606 | B2 | 11/2006 | Suga et al. | 271/97 |
| 7,316,391 | B2 * | 1/2008 | Stemmle | 271/161 |
| 2003/0080497 | A1 * | 5/2003 | Matsushima et al. | 271/171 |
| 2006/0033259 | A1 * | 2/2006 | Yamada | 271/147 |
| 2006/0113725 | A1 * | 6/2006 | Ito | 271/171 |
| 2006/0180998 | A1 * | 8/2006 | Lee et al. | 271/171 |
| 2006/0222434 | A1 * | 10/2006 | Kitamura et al. | 400/624 |
| 2006/0267267 | A1 * | 11/2006 | Koga | 271/122 |
| 2007/0194517 | A1 * | 8/2007 | Nose et al. | 271/171 |
| 2007/0257419 | A1 * | 11/2007 | Wilcox et al. | 271/148 |
| 2008/0061496 | A1 * | 3/2008 | Hashimoto et al. | 271/147 |

FOREIGN PATENT DOCUMENTS

| | | | |
|---|---|---|---|
| JP | 58017028 | A * | 2/1983 |
| JP | 58052142 | A * | 3/1983 |
| JP | 60040335 | A * | 3/1985 |
| JP | 62215448 | A * | 9/1987 |
| JP | 63277146 | A * | 11/1988 |
| JP | 05278870 | A * | 10/1993 |
| JP | 2001-97564 | | 4/2001 |

* cited by examiner

SHEET FEEDING DEVICE AND IMAGE FORMING APPARATUS

BACKGROUND OF THE INVENTION

1. Field of the Invention

The present invention relates to a sheet feeding device which feeds a sheet and an image forming apparatus.

2. Description of the Related Art

In a conventional sheet storing portion which is arranged in a sheet feeding device and which stores sheets, a sheet tray which supports a sheet stack and a side regulating plate to regulate and position the sheet stack supported on the sheet tray are arranged. The side regulating plate is arranged movable depending on a size of a sheet to be supported. A notched portion is formed in the side regulating plate to make it possible to move the side regulating plate.

However, when the side regulating plate is long in a sheet feeding direction, skew feeding of a sheet is regulated and to make it possible to stably feed the sheet. However, when the side regulating plate is long, the notched portion formed in the sheet tray increases in size. For this reason, the sheet is hanged down by its own weight from the notched portion of the sheet tray. As a result defective feeding that a sheet cannot be fed or is skew-fed is caused. Alternatively the sheet is fed while being bent to cause defective recording.

As countermeasures against this drawback, for example, a sheet feeding device having configurations shown in FIGS. 8 and 9 is proposed. These diagrams are plan views showing a main part of a sheet storing portion. In the sheet storing portion, a sheet tray 21, a side regulating plate 25, and an auxiliary plate 30 are arranged. The sheet tray 21 is vertically movably arranged in the sheet storing portion. The sheet tray 21 can support and lift up a recording sheet P. The side regulating plate 25 can be moved in a sheet width direction (perpendicular to a sheet feeding direction) depending on a size of a recording sheet supported by the sheet tray 21. The side regulating plate 25 regulates side edges of the recording to position the recording sheet.

In the sheet tray 21, a notched portion 27 is formed to avoid interference of the side regulating plate 25 in a moving state. The auxiliary plate 30 is swingably arranged on the sheet tray 21 by using a pin 31 as a rotating shaft. The auxiliary plate 30 partially covers the notched portion 27 (part corresponding to a rear-end portion of the recording sheet) to support the recording sheet P together with the sheet tray 21.

As shown in FIG. 8, the auxiliary plate 30 supports a recording sheet P having a large size placed on the sheet tray 21 depending on the recording sheet P not to hang down the recording sheet P in the notched portion 27. As shown in FIG. 9, when a recording sheet P having a small size is stored, the auxiliary plate 30 is swingably retreated depending on movement of the side regulating plate 25. As a technique which prevents a sheet from being hanged down by using such an auxiliary plate, a technique is disclosed in Japanese Patent Application Laid-open No. 2001-097564. However, in a conventional technique, in a large-size sheet storing portion to store recording sheets having large sizes, a side regulating plate is long in a sheet feeding direction, a notched portion of a sheet tray is large in a recording sheet feeding direction. In the large-size sheet storing portion copes with sheets having small sizes (for example, B5, A4, post card, or the like), since a moving range of the side regulating plate in a recording width direction increases, a notched portion of the sheet tray increases in a width direction of a recording sheet.

When the notched portion of the sheet tray is large, the above auxiliary plate which covers only a rear-end portion of a recording sheet is so insufficient that the recording sheet cannot be prevented from being hanged down.

Therefore, in the large-size sheet storing portion, the side regulating plate may be shortened or separately arranged to reduce a notched portion formed in a sheet tray in size so as to assure a holding surface of a recording sheet.

However, in the configuration, since a recording sheet regulating surface of the side regulating plate is shortened, the effect prevents the recording sheet from being skew-fed is considerably deteriorated.

SUMMARY OF THE INVENTION

Therefore, the present invention has as its object to provide a sheet feeding device which can widely cope with recording sheets having a large size to a small size, prevents a recording sheet from being hanged down, and can stably supply a recording sheet.

In order to solve the above problem, the prevent invention provides a sheet feeding device including:

a sheet storing portion which stores a plurality of sheets;

a sheet tray which is vertically movably arranged in the sheet storing portion and which can support a plurality of sheets on a sheet placing surface;

a side regulating member which is arranged such that the side regulating member can be freely moved in a notched portion formed in the sheet placing surface in the sheet width direction and which regulates side edges of sheets supported by the sheet tray;

an auxiliary tray which is swingably arranged on the sheet tray and which constitutes a sheet placing surface which supports the sheets in the notched portion;

a cutout portion which is formed in the side regulating member into which the auxiliary tray is inserted; and a contact portion which is brought into contact with the auxiliary tray at a predetermined level to swing the auxiliary tray downward when the sheet tray moves upward.

BRIEF DESCRIPTION OF THE DEAWINGS

DESCRIPTION OF THE EMBODIMENTS

An embodiment of a sheet feeding device and an image forming apparatus according to the present invention will be described below with reference to the accompanying drawings.

(Entire Image Forming Apparatus)

Figure 1:
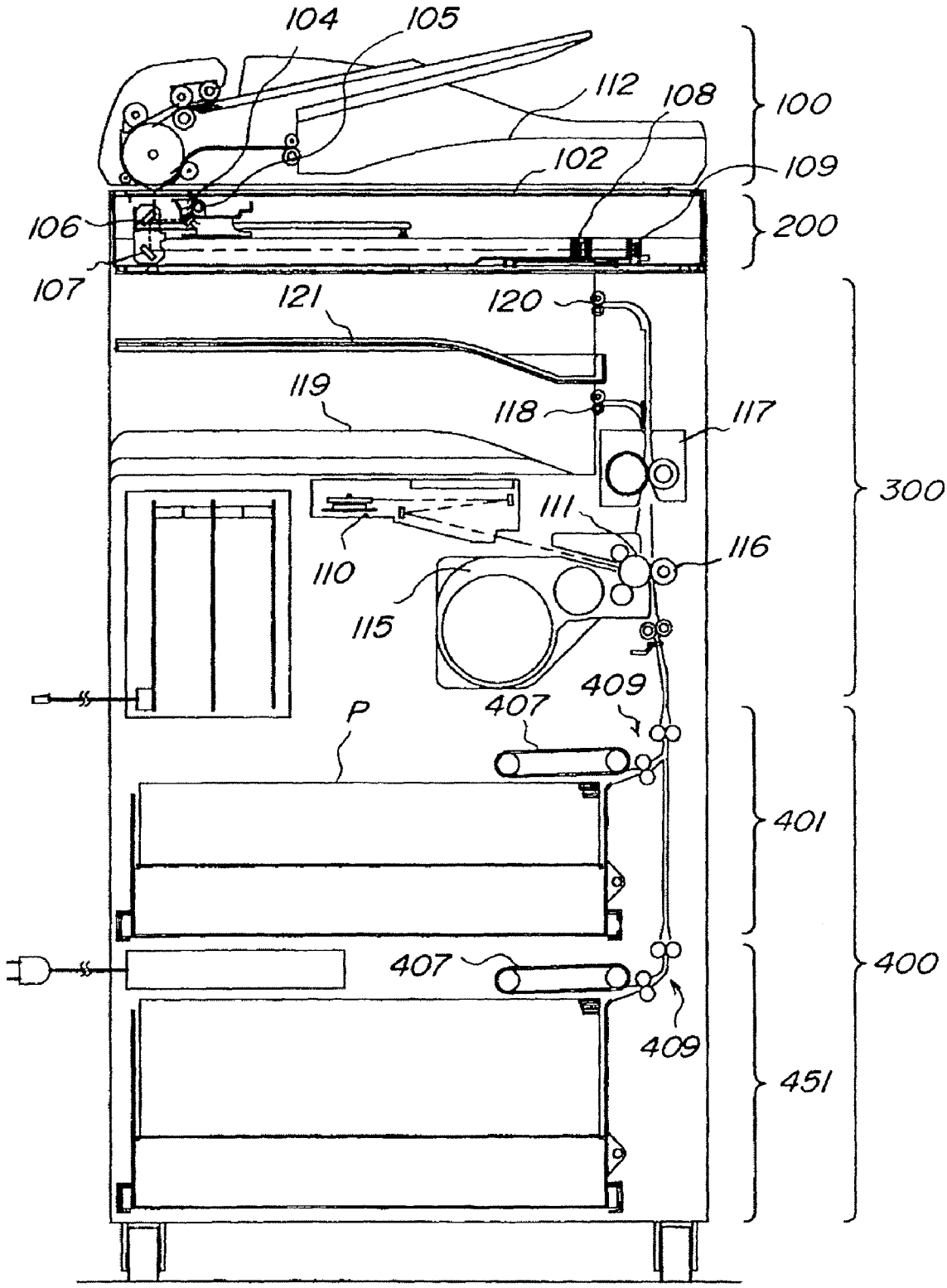
FIG. 1 is a sectional view of an image forming apparatus according to an embodiment.

As shown in FIG. 1, an image forming apparatus has an image reader 200 which reads an original image, a printer 300, and a sheet feeding device 400.

An original feeding device 100 is mounted on the image reader 200. The original feeding device 100 sequentially feeds originals set upward on an original sheet tray from a front page one by one, and the originals are conveyed through a curved path from left to right to pass through a flow-read position on a platen glass 102. Thereafter, the originals are discharged to an external discharge sheet tray 112.

More specifically, when the original passes through the flow-read position, an original read surface is irradiated with a beam from a lamp 103 of a scanner unit 104 to guide a reflected beam from the original to a lens 108 through mirror 105, 106, and 107. The beam passing through the lens 108 is focused on an image-pickup surface of an image sensor 109.

In this manner, when the original is conveyed such that the original passes through the flow-read position from left to right, original read scanning is performed by setting a direction perpendicular to an original conveyance direction as a main scanning direction and setting the conveyance direction as a sub-scanning direction. More specifically, the original is conveyed in the sub-scanning direction while an original image is read by the image sensor 109 every line in the main scanning direction when the original is passed through the flow-read position.

In this manner, the entire original image is read, and the optically read image is converted by the image sensor 109 into image data to output the image data. The image data output from the image sensor 109 is subjected to a predetermined process by an image signal controller (not shown) and then input to an exposure controller 110 of the printer 300 as a video signal.

The printer 300 includes the exposure controller 110, an image forming portion (a photosensitive drum 111 and a transfer portion 116), a fixing device 117, a first discharge roller 118, a second discharge roller 120, a first discharge sheet tray 119, and a second discharge sheet tray 121.

The exposure controller 110 modulates a laser beam on the basis of a video signal input from the original feeding device 100 or the like to output the modulated laser beam. The output laser beam is irradiated on the photosensitive drum 111 while being scanned by a rotary polygon mirror. An electrostatic latent image depending on the scanned laser beam is formed on the photosensitive drum 111. The exposure controller 110 outputs the laser beam in original fixed reading such that a correct image (which is not a mirror image) is formed.

The electrostatic latent image on the photosensitive drum 111 is made visual image as a developer image by a developer supplied from a development device 115. At a timing synchronized with the start of irradiation of the laser beam, a recording sheet P is fed from the sheet feeding device 400, and the recording sheet P is conveyed between the photosensitive drum 111 and the transfer portion 116. The developer image formed on the photosensitive drum 111 is transferred on the recording sheet P fed by the transfer portion 116.

The recording sheet P to which the developer image is transferred is conveyed to the fixing device 117. The fixing device 117 heats and pressures the recording sheet P to fix the developer image on the recording sheet P. The recording sheet P passing through the fixing device 117 is discharged to the first discharge sheet tray 119 through the first discharge roller 118 or to the second discharge sheet tray 121 through the second discharge roller 120 by switching a flapper (not shown).

(Sheet Feeding Device 400)

The sheet feeding device 400 has paper decks 401 and 451 which are sheet storing portions having a common sheet feeding mechanism. The paper deck 401 can store up to 1500 recording sheets. The paper deck 451 can store up to 2000 recording sheets.

The sheet feeding device 400 employs an air feeding system which separately feeds sheets one by one by an air-loosening/air-sucking belt 407. The recording sheet P sent by the air-sucking belt 407 is fed to the printer 300 by a feeding roller 409.

Figure 2:
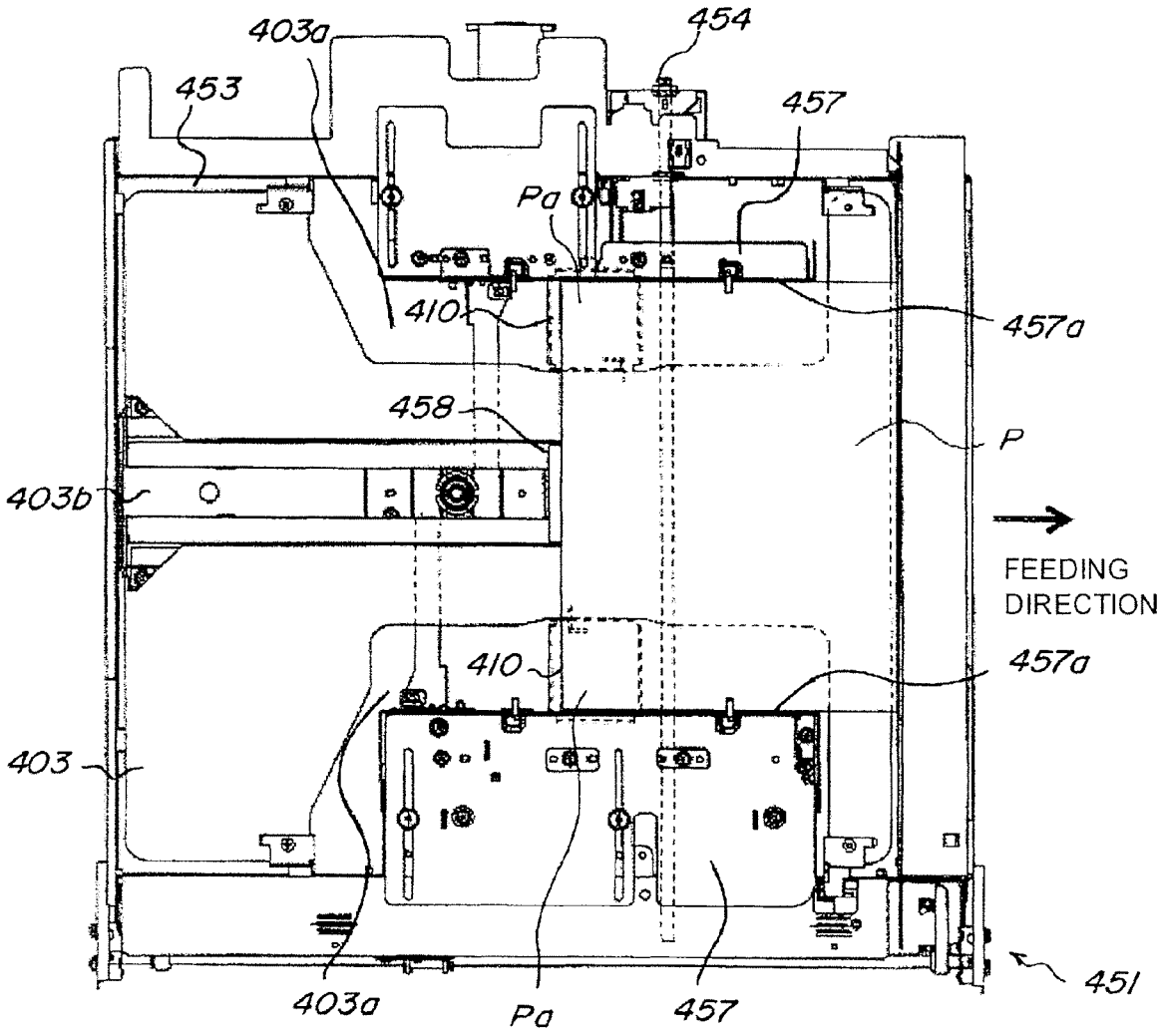
FIG. 2 is a plan view of a paper deck.

Here, the paper deck 451 will be described in detail. FIG. 2 is a plan view of the paper deck 451 according to the embodiment. As shown in FIG. 2, the paper deck 451 includes a sheet storing portion 453 to place and store a plurality of recording sheets. The sheet storing portion 453 has a sheet tray 403, a lifter elevating mechanism 454, a side regulating plate 457 serving as a side regulating member, and a rear-end regulating plate 458 therein.

The sheet tray 403 supports a recording sheet P stored in the sheet storing portion 453. The lifter elevating mechanism 454 vertically moves the sheet tray 403 which support the recording sheet P. In this case, the lifter elevating mechanism 454 vertically moves the sheet tray 403 such that a wire (not shown) connected to the sheet tray 403 is winded or rewinded by a motor (not shown). The recording sheet P is added or replaced at a lower position of the sheet tray 403, and the recording sheet P is supported and moved upward. In a feeding operation of a recording sheet, the lifter elevating mechanism 454 vertically moves the sheet tray 403 on the basis of detection of a sensor (not shown) such that an upper surface of an uppermost recording sheet is substantially set at a predetermined level (feeding position).

The side regulating plate 457 can be freely moved depending on a size of the recording sheet P and regulates a position of the recording sheet P in a sheet width direction. The rear-end regulating plate 458 can be freely moved depending on the size of the recording sheet P and regulates a position of the recording sheet P in the sheet feeding direction on an upstream side.

The paper deck 451 can store a sheet having a size of B5R to 14.33 inches (182 mm to 364 mm) in sheet width and a size of B5 to 19.2 inches (182 mm to 488 mm) in sheet length. Therefore, in the sheet tray 403, a notched portion 403*a* is formed from a side end to the inside in a moving range of the side regulating plate 457 to prevent the movement of the side regulating plate 457 from being blocked. In the sheet tray 403, a notched portion 403*b* is formed from a rear end to the inside in a moving range of the rear-end regulating plate 458 to prevent the movement of the rear-end regulating plate 458 from being blocked.

The notched portions 403*a* and 403*b* are necessarily large in the feeding direction and the sheet width direction because side ends of recording sheets having a small size to a large size must be regulated. More specifically, the side regulating plate 457 improve the ability to prevent skew feeding such that a sheet regulating surface 457*a* which prevents skew feeding is elongated in the feeding direction. In this manner, the paper deck 451 has the side regulating plate 457 which copes with various sheet sizes, has high ability to prevent skew feeding, and has a long regulating surface.

However, depending on a size of the recording sheet P, a rear corner Pa of the recording sheet P may largely covers the notched portion 403*a* of the sheet tray 403. For example, a size of the recording sheet P in FIG. 2 is LTR (279 mm in width and 216 mm in length).

Figure 7:
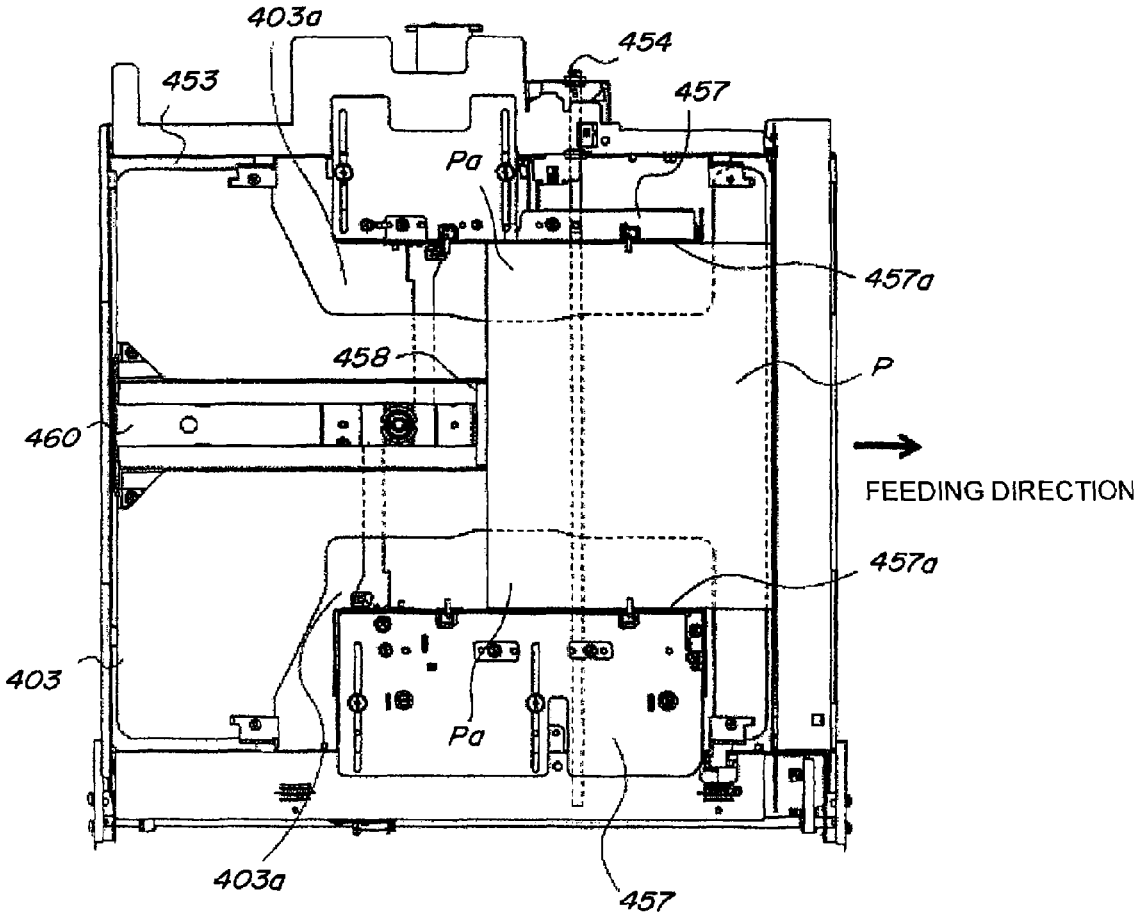
FIG. 7 PRIOR ART
FIG. 7 is a plan view of a conventional paper deck.
Figure 8:
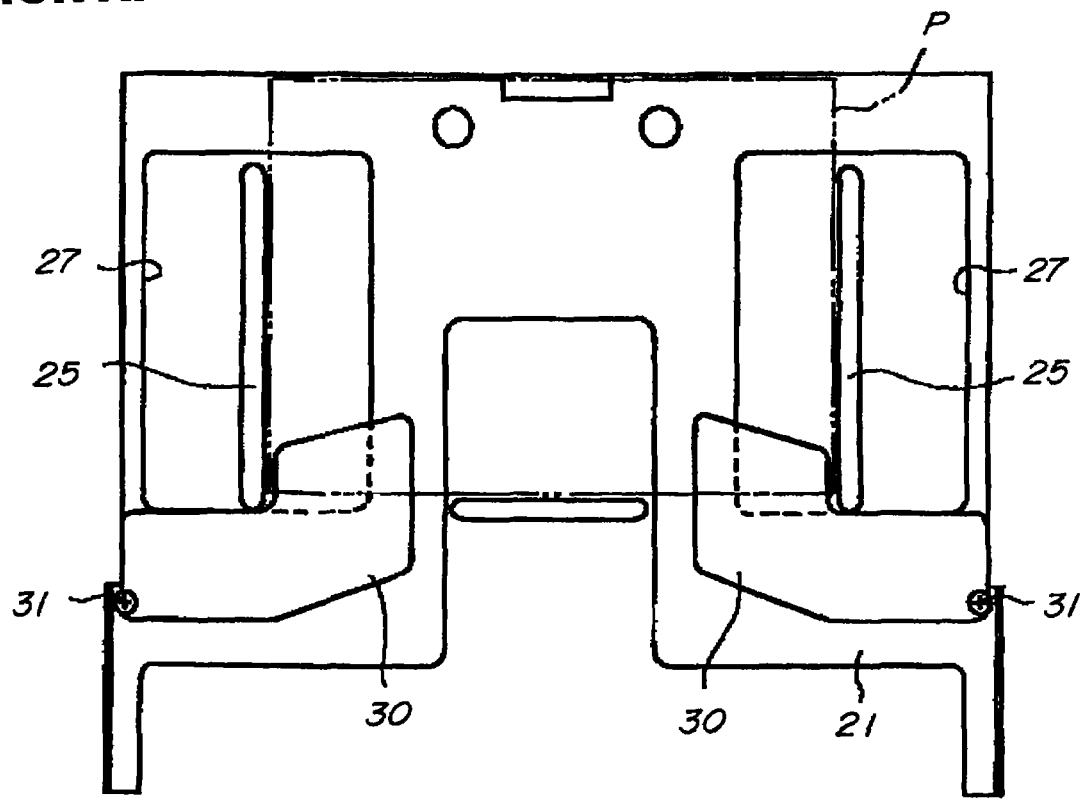
FIG. 8 PRIOR ART
FIG. 8 is an explanatory view of the conventional paper deck.
Figure 9:
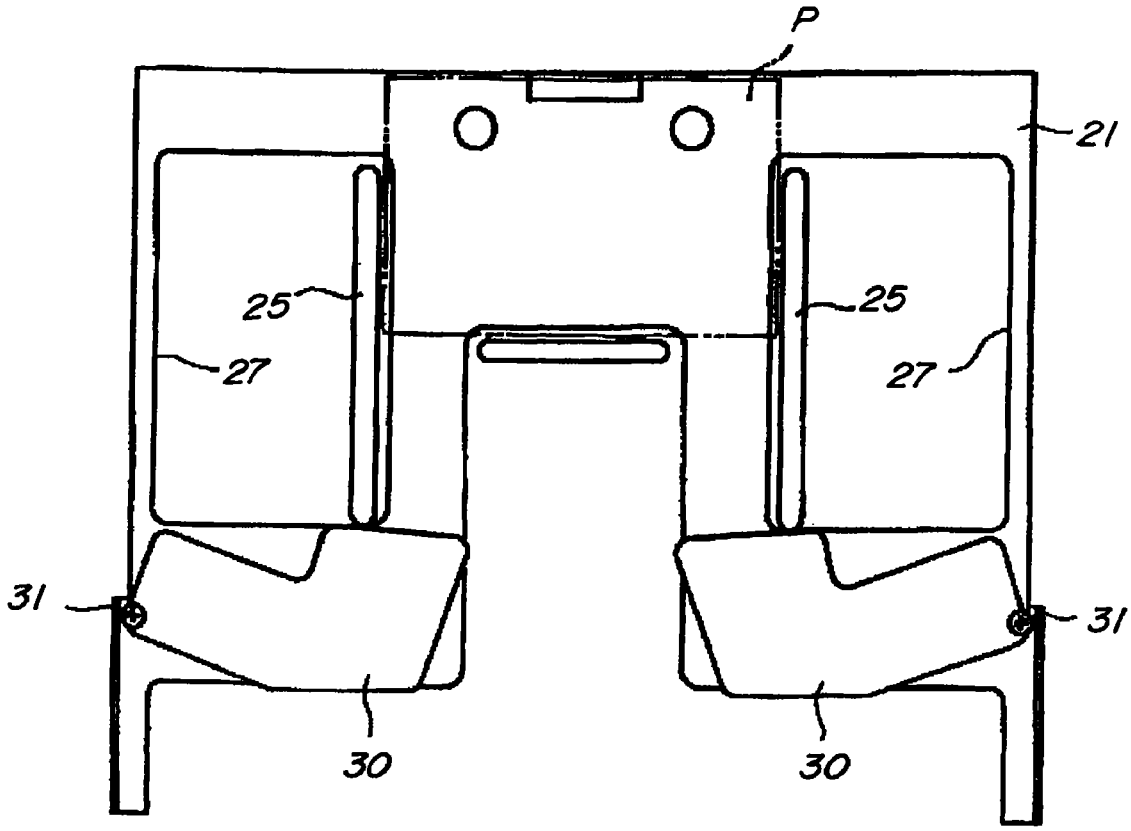
FIG. 9 PRIOR ART
FIG. 9 is an explanatory view of the conventional paper deck.

In a conventional paper deck shown in FIG. 7, when a large number of recording sheets P are placed when the rear corner Pa is located at the notched portion 403*a*, the rear corner Pa is hanged down by its own weight. When the sheet P is kept in this state, the recording sheet P is kept hanged down (curled). This causes drawbacks such as skew feeding of the recording sheet, occurrence of paper jam, and defective recording on the recording sheet. Furthermore, when a large number of large-size recording sheets having low rigidity are placed, a side end may be partially hanged down from the notched portion 403*a* by its own weight. In this case, the recording sheet is also kept hanged down (curled). This causes drawbacks such as skew feeding of the recording sheet, occurrence of paper jam, and defective recording on the recording sheet.

Therefore, on the paper deck 451 according to the embodiment, as shown in FIG. 2, an auxiliary tray 410 is arranged at a center of the notched portion 403*a* in the feeding direction. The auxiliary tray 410 can prevent a recording sheet from being hanged down. More specifically, when a small-size recording sheet is used, the auxiliary tray 410 can support a corner Pa overlapping the notched portion 403*a*. In this manner, a recording sheet can be prevented from being hanged down at the notched portion 403*a* to make it possible to perform stable feeding. In addition, when a large-size recording sheet is used, a side end overlapping the notched portion 403*a* can be supported, the recording sheet can be prevented from being hanged down to make it possible to perform stable feeding.

(Configuration and Operation of Auxiliary Tray 410)

Figure 3:
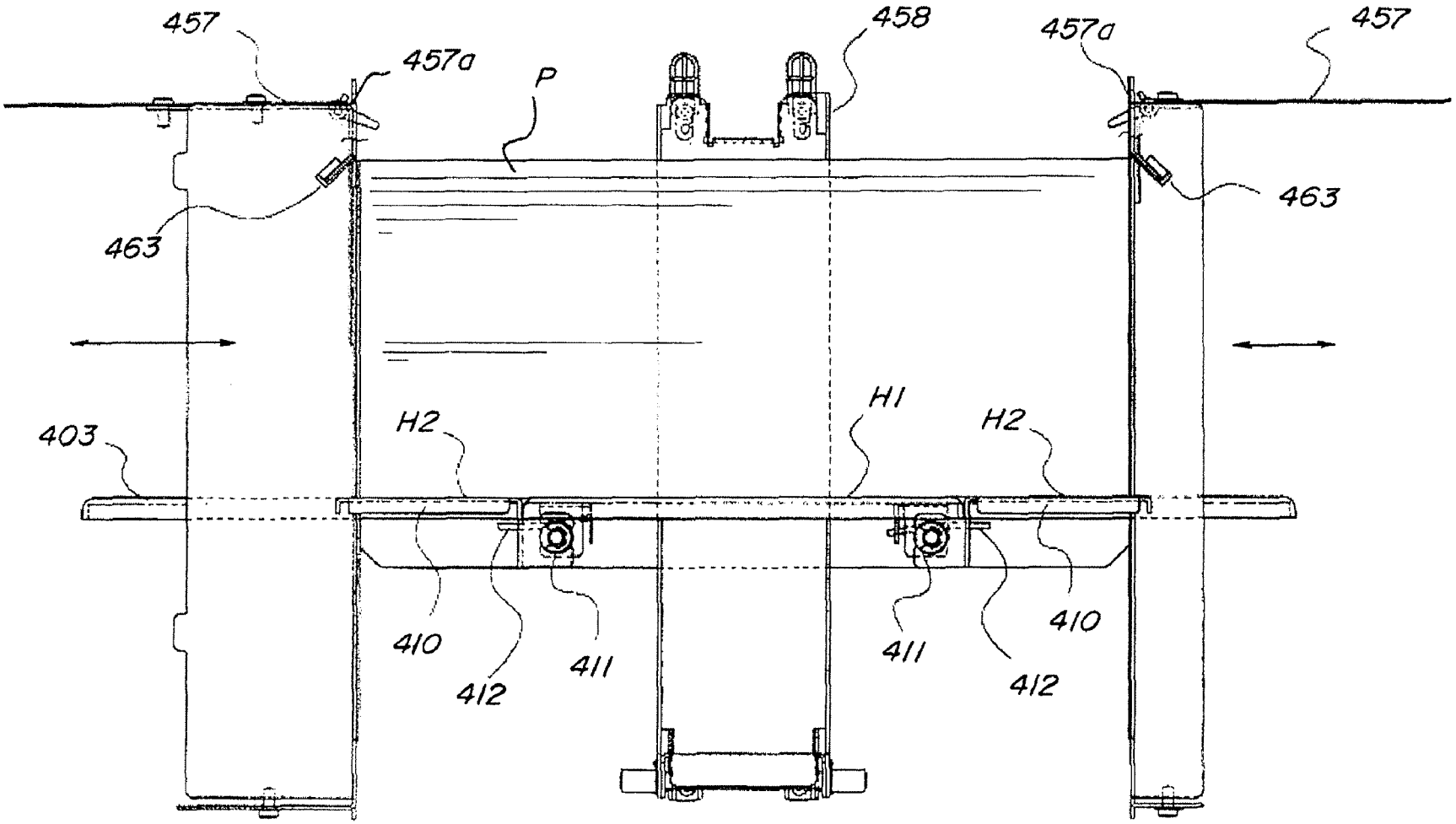
FIG. 3 is a side sectional view of the paper deck on which a large number of sheets are placed.
Figure 4:
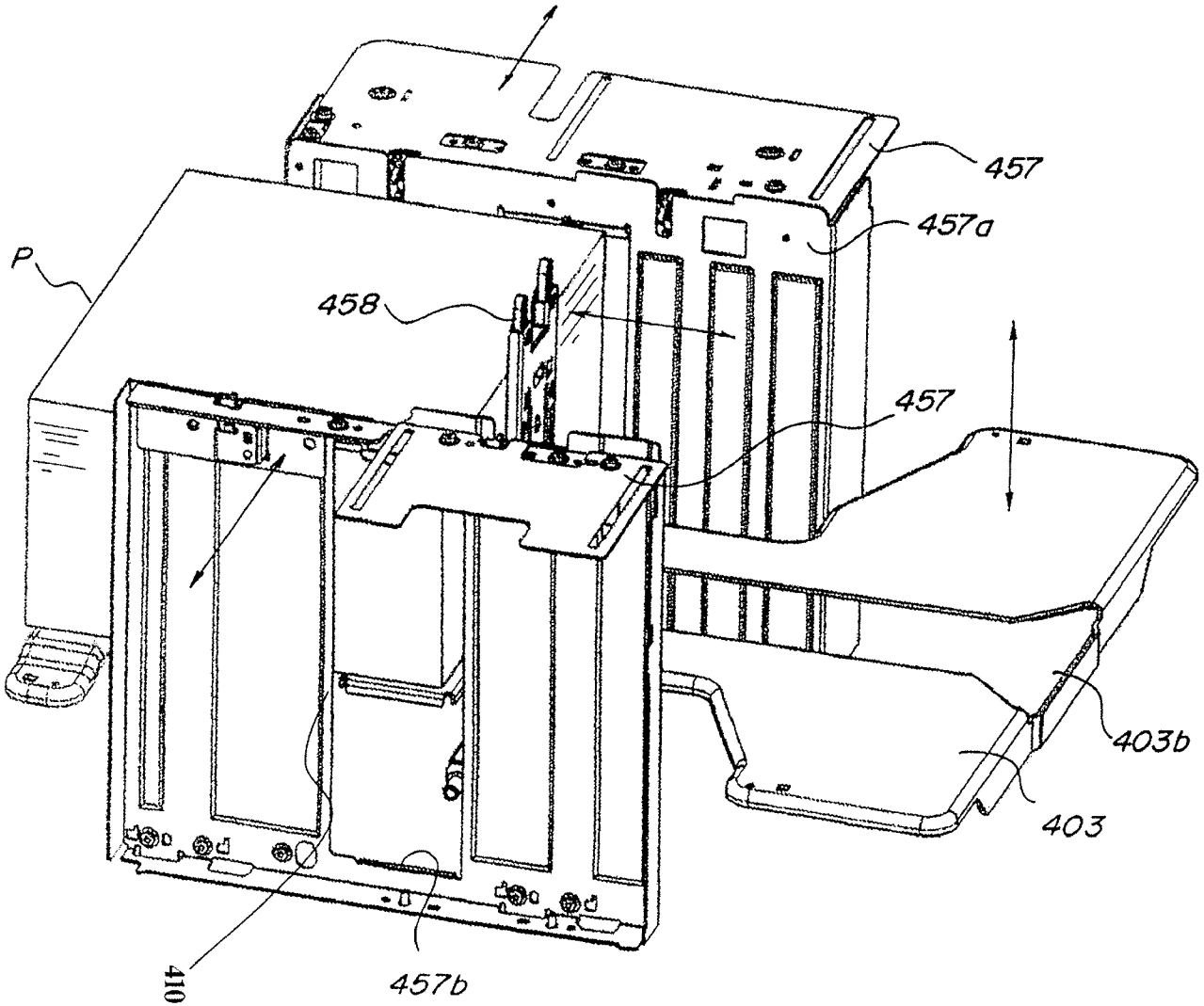
FIG. 4 is a perspective view of the paper deck on which a large number of sheets are placed.

A configuration and an operation of the auxiliary tray 410 which is a characteristic feature of the present invention will be described below with reference to FIGS. 3 to 6. FIG. 3 is a side sectional view of the paper deck 451 according to the embodiment when viewed from a downstream side in a feeding direction and shows a state in which a large number of recording sheets each having an LTR size are placed. FIG. 4 is a perspective view of the paper deck 451 in the state shown in FIG. 3.

As shown in FIG. 3, the auxiliary tray 410 is swingably arranged about a swing shaft 411 fixed to a lower-surface side of the sheet tray 403. The auxiliary tray 410 has a sheet placing surface H2 to support a sheet, and is swingably applied with a force in such a direction that a free end side is lift up by a force-applying spring (elastic member) 412. The auxiliary tray 410 is regulated by a stopper (not shown) such that the sheet placing surface H2 is located on the substantially same plane as that of a sheet placing surface H1 in a normal state.

The (elastic) force of the force-applying spring (elastic member) 412 is properly set by a capacity of the paper deck 451 or a shape of the notched portion 403*a* of the sheet tray 403. More specifically, the applied force is set such that the sheet placing surface H2 can be kept on the same plane as that of the sheet placing surface H1 and is not hanged down even though the weight of a large number of recording sheets P (maximum number of recording sheets) is loaded on the notched portion 403*a*. In the embodiment, the applied force is set at 3 kgf.

As shown in FIG. 4, in the side regulating plate 457, a hole 457*b* serving as a cutout portion to make it possible to insert an end of the auxiliary tray 410 from the sheet tray 403 side is formed. The hole 457*b* is a long hole opened at a center of the side regulating plate 457 in the sheet feeding direction and extending in a direction of height of the placed sheets. The hole 457*b* is formed at a level lower than a position having a predetermined level. The hole 457*b* is not formed at a level higher than the position of the predetermined level because an upper portion of the placed recording sheets must be reliably regulated. More specifically, if the hole 457*b* is formed in an upper end of the side regulating plate 457, the side regulating plate 457 becomes weak in rigidity and is easily bent to deteriorate the flatness or to narrow a range in which recording sheets are regulated. As a result, regulating accuracy is deteriorated. Therefore, the upper portion of the side regulating plate 457 is closed to make it possible to set the length of the sheet regulating surface 457*a* for regulating the recording sheet in the sheet feeding direction long, and the recording sheets can be stably fed. A contact portion 463 (will be described later) is formed on an upper edge of the hole 457*b* of the side regulating plate 457.

Figure 5:
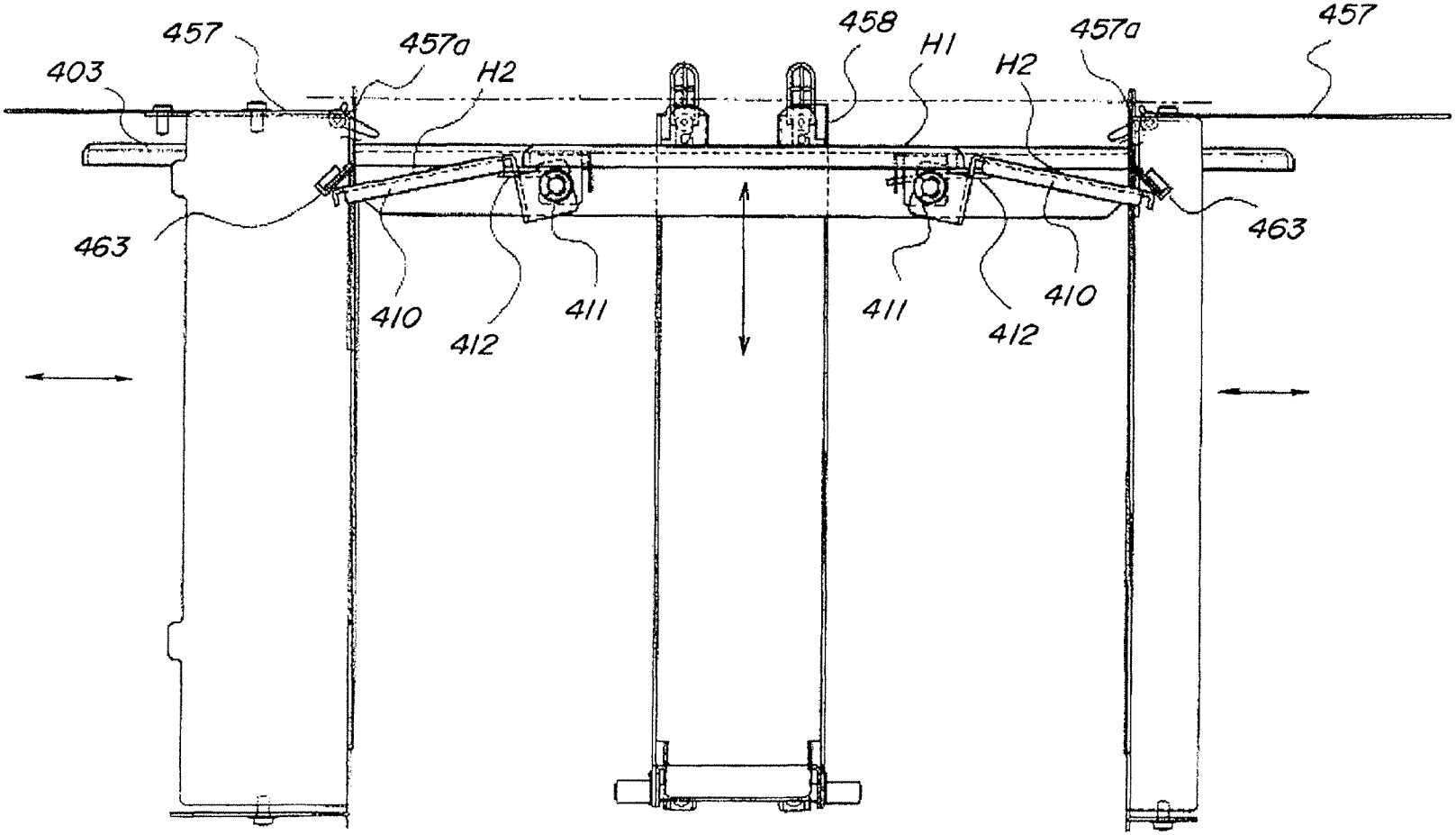
FIG. 5 is a perspective view of the paper deck on which a small number of sheets are placed.
Figure 6:
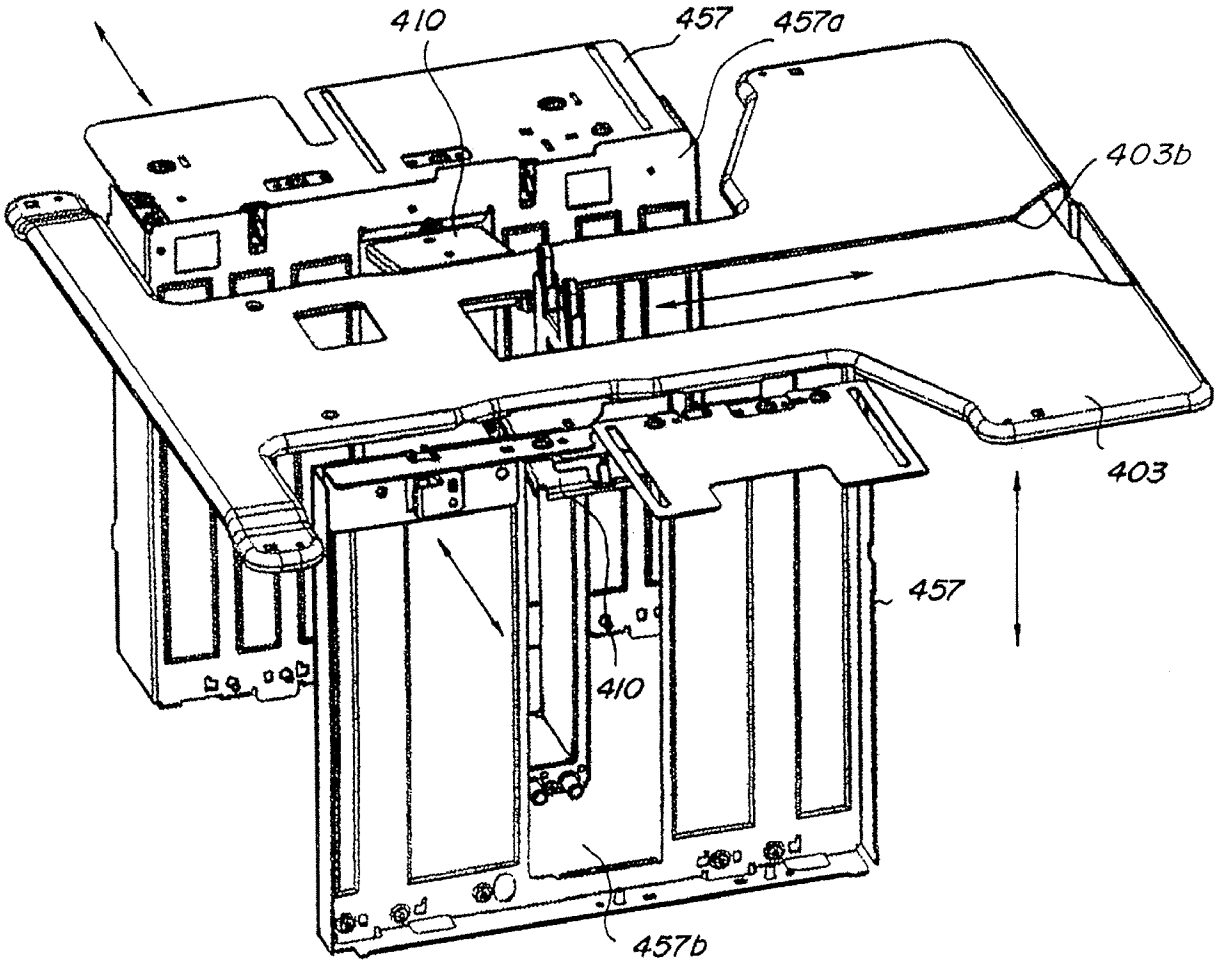
FIG. 6 is a perspective view of the paper deck on which a small number of sheets are placed.

An operation performed when a small number of recording sheets P are placed will be described below with reference to FIGS. 5 and 6. As described above, the moving range of the side regulating plate 457 in the sheet width direction partially overlaps the moving range of the auxiliary tray 410 when the sheet tray 403 moves. In the overlapping region, the side regulating plate 457 has the hole 457*b* into which the auxiliary tray 410 can be inserted. For this reason, even though the side regulating plate 457 is reduced in width to cope with a sheet having a narrow width, the sheet placing surface H2 of the auxiliary tray 410 can be assured without interference between the auxiliary tray 410 and the side regulating plate 457.

Although the side regulating plate 457 has the hole 457*b*, the side regulating plate 457 is closed at the upper position. For this reason, since the closed portion at the upper position of the sheet regulating surface 457*a* can regulate a recording sheet on a feeding position to send the uppermost recording sheet over the entire length of the sheet in the feeding direction, the effect that prevents skew feeding of the recording sheet P can be improved. Furthermore, the rigidity of the side regulating plate 457 itself can be improved, a slidably moving operation of the side regulating plate 457 in a change in size of sheets is preferably performed.

When the recording sheet P are sequentially fed to reduce the number of placed sheets, the sheet tray 403 is moved upward such that the upper surface of the uppermost recording sheets is substantially at a predetermined level. When the sheet tray 403 gradually moves upward, the auxiliary tray 410 is brought into contact with the contact portion 463 formed on the upper edge of the hole 457*b* to swingably retreat the auxiliary tray 410 about the swing shaft 411. In the embodiment, the auxiliary tray 410 is designed to be brought into contact with the contact portion 463 to start the swingable retreat when the sheet tray 403 is located at a position which is lower than a sheet feeding position by about 30 mm.

Subsequently, since the auxiliary tray 410 is swingably retreated downward, the auxiliary tray 410 does not support a recording sheet. However, at this time, since a small number of recording sheets P remain, even though the sheet placing surface H2 of the auxiliary tray 410 is located at the position (on the same plane as that of the sheet placing surface H1) where the sheet placing surface H2 supports the recording sheet P, hanging-down of the recording sheet P is extremely small and can be neglected. The present invention is not limited to the configuration in which the auxiliary tray 410 is brought into contact with the contact portion 463 and swung. The present invention may employs a configuration in which the auxiliary tray 410 is brought into direct contact with the upper edge of the hole 457*b* and swung. In this case, the upper edge serves as a contact portion.

With the above configurations described above, the side regulating plate 457 is slid to make it possible to widely cope with recording sheets having a large size to a small size. The auxiliary tray 410 supports a corner Pa of a small-size recording sheet at the notched portion 403*a* or a side end of a large-size recording sheet to make it possible to prevent the recording sheet P from being hanged down.

In this manner, the auxiliary tray 410 can support a recording sheet placed on the sheet tray 403 and overlapping the notched portion 403*a*. In this manner, the sheet can be prevented from being hanged down at the notched portion 403*a*. For this reason, the recording sheet can be stably fed. Furthermore, the side regulating plate 457 is closed on its upper side although the hole 457*b* is formed, and the upper end of the hole 457*b* is brought into contact with the contact portion of the upper end of the hole 457*b* to swingably retreat the auxiliary tray 410. In this manner, since a recording sheet at a feeding position can be regulated by the sheet regulating surface 457*a* of the side regulating plate 457 over the entire length of the sheet in the feeding direction, skew feeding can be suppressed from occurring, and the recording sheet can be stably supplied.

This application claims the benefit of priority from the prior Japanese Patent Application No. 2006-099058 filed on Mar. 31, 2006 the entire contents of which are incorporated by reference herein.

What is claimed is:

1. A sheet feeding device comprising:

a sheet storing portion which stores a plurality of sheets;

a sheet tray which is vertically movably arranged in the sheet storing portion and which can support a plurality of sheets on a sheet placing surface;

a side regulating member which is arranged such that the side regulating member can be freely moved in a notched portion formed in the sheet placing surface in the sheet width direction and which regulates side edges of sheets supported by the sheet tray;

an auxiliary tray which is swingably arranged on the sheet tray and which constitutes a sheet placing surface which supports the sheets in the notched portion;

a cutout portion which is formed in the side regulating member into which the auxiliary tray is movably inserted; and a contact portion which is brought into contact with the auxiliary tray at a predetermined level to swing the auxiliary tray downward when the sheet tray moves upward.

2. The sheet feeding device according to claim 1, wherein the contact portion is formed on an upper edge of the cutout portion formed in the side regulating member.

3. The sheet feeding device according to claim 1, wherein the auxiliary tray is applied with a force by an elastic member such that the sheet placing surface of the auxiliary tray is located on the same plane as that of the sheet placing surface of the sheet tray.

4. The sheet feeding device according to claim 1, wherein the auxiliary tray is arranged at a position where the auxiliary tray supports an upstream end of a small-size sheet to be placed in a sheet feeding direction.

5. An image forming apparatus including a sheet feeding device to supply a sheet to an image forming portion, comprising:

a sheet storing portion which stores a plurality of sheets;

a sheet tray which is vertically movably arranged in the sheet storing portion and which can support a plurality of sheets on a sheet placing surface;

a side regulating member which is arranged such that the side regulating member can be freely moved in a notched portion formed in the sheet placing surface in the sheet width direction and which regulates side edges of sheets supported by the sheet tray;

an auxiliary tray which is swingably arranged on the sheet tray and which constitutes a sheet placing surface which supports the sheets in the notched portion;

a cutout portion which is formed in the side regulating member into which the auxiliary tray is inserted; and a contact portion which is brought into contact with the auxiliary tray at a predetermined level to swing the auxiliary tray downward when the sheet tray moves upward.

* * * * *